US006095165A

United States Patent [19]

Mastronardi

[11] Patent Number: 6,095,165

[45] Date of Patent: Aug. 1, 2000

[54] TABLE DISHWASHER

[76] Inventor: William Mastronardi, 1510 Union Ave., Kingsville, Ontario, Canada, N9Y 3Y1

[21] Appl. No.: 09/246,617

[22] Filed: Feb. 8, 1999

[51] Int. Cl.[7] ..... A47L 15/42

[52] U.S. Cl. ..... 134/115 R; 134/143; 134/200

[58] Field of Search ..... 134/115 R, 135, 134/143, 200

[56] References Cited

U.S. PATENT DOCUMENTS

| | | | |
|---|---|---|---|
| 317,766 | 5/1885 | Groves | 134/115 R X |
| 2,502,265 | 3/1950 | Macon | 134/115 R |
| 2,750,611 | 6/1956 | Cahtel | 134/115 R X |
| 2,971,519 | 2/1961 | Willson | 134/115 R X |
| 3,152,599 | 10/1964 | Grimes | 134/115 R |
| 4,606,464 | 8/1986 | Jordan et al. | 211/41 |
| 5,249,590 | 10/1993 | Jacobus et al. | 134/135 |
| 5,344,029 | 9/1994 | Oghia et al. | 211/41 |
| 5,351,837 | 10/1994 | Smith | 211/41 |
| 5,480,035 | 1/1996 | Smith | 211/41 |
| 5,601,195 | 2/1997 | Finola et al. | 211/41 |
| 5,687,752 | 11/1997 | Boylan | 134/115 R |

FOREIGN PATENT DOCUMENTS

| | | | |
|---|---|---|---|
| 668649 | 12/1965 | Belgium | 134/115 R |

*Primary Examiner*—Philip R. Coe
*Attorney, Agent, or Firm*—Henderson & Sturm LLP

[57] ABSTRACT

A table dishwasher combination including an access door slidably connected to the table top side members to allow a pair of dishwasher racks to rise upwardly from the central compartments wherein one of the dish racks pivots to the left and one pivots to the right to allow for loading by people seated at the table.

8 Claims, 1 Drawing Sheet

TABLE DISHWASHER

BACKGROUND OF THE INVENTION

1. Field of the Invention

The present invention relates to the field of household appliances, and more particularly to a dining table dishwasher combination.

2. Description of Related Art

As can be seen by reference to the following U.S. Pat. Nos., 4,606,464; 5,249,590; 5,344,029; 5,351,837; 5,480,035; and 5,601,195, the prior art is replete with myriad and diverse dishwasher modifications.

While all of the aforementioned prior art constructions are more than adequate for the basic purpose and function for which they have been specifically designed, they are uniformly deficient with respect to their failure to provide a simple, efficient, and practical dining table dishwasher combination.

As a consequence of the foregoing situation, there has existed a longstanding need for a new and improved type of dining table dishwasher combination and the provision of such a construction is a stated objective of the present invention.

BRIEF SUMMARY OF THE INVENTION

Briefly stated, the present invention provides a table dishwasher combination including an access door slidably connected to the table top side members to allow a pair of dishwasher racks to rise upwardly from the central compartments wherein one of the dish racks pivots to the left and one pivots to the right to allow for loading by people seated at the table.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
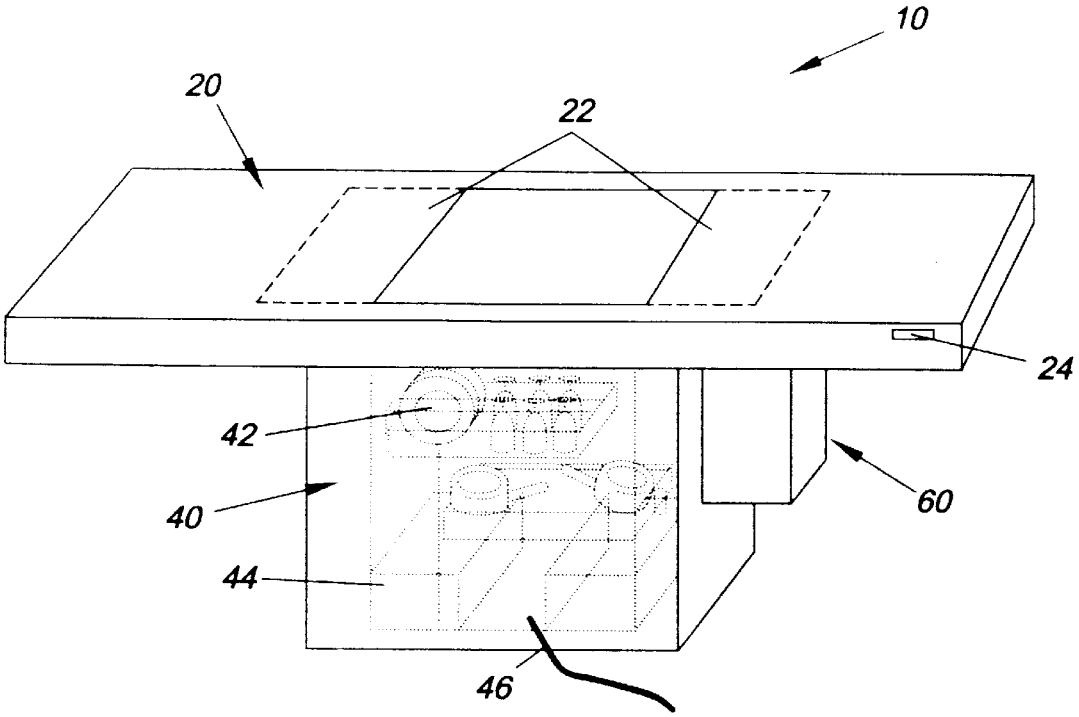
FIG. 1 is a perspective view of the table dishwasher of the present invention showing the sliding doors in the closed position, and having portions cut away to show the dishwasher and dish racks in the central compartment.
Figure 2:
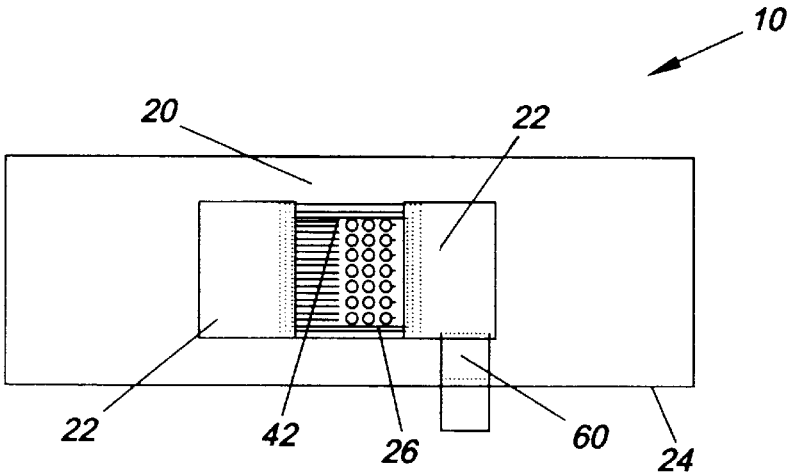
FIG. 2 is a top plan view showing the sliding doors in the open position and showing the trash receptacle in the extended position.

As can be seen by reference to the drawings, and in particularly to FIG. 1, the table dishwasher that forms the basis of the present invention is designated generally by the reference number 10. The concept of the table dishwasher 10 is that of a redesigned kitchen table 20 incorporating a centrally placed dishwasher 40 and retractable trash receptacle 60 allowing a family to easily set a table, and clean up faster after mealtime.

The table dishwasher 10 may be produced in a variety of sizes and incorporate a top loading dishwasher assembly 40 and side mounted retractable trash container 60 insider a dinner table 20. Access to the dishwasher interior is provided by sliding track doors 22 surrounded by rubber gaskets mounted in the center of the table 20. Control of the doors 22 is provided by a button 24 on the side of the table 20. The dish washing assembly 40 of the table dishwasher 10 provides a variety of settings and options which may be controlled by a covered panel. The top and bottom dish trays 42 and 44 inside the dishwasher assembly 40 are each attached to swivel mounts. Each swivel mount is then attached to a column with a hydraulically powered strut. While loading and unloading, the struts raise the trays 42 and 44 out the table opening 26, then swivel the trays 42 and 44 to the left or right. Water and hydraulic assemblies are supplied by an attached hose 46 which joins to the user's home plumbing system.

In use, a user replaces his standard dining table and dishwasher unit with the table dishwasher 10. Once installed to the user's plumbing system, the table dishwasher 10 is operated by pressing a control button 24 to open the table center 26 and raise the dish trays 42 and 44. Once raised to their full height, each tray 42 and 44 swivels out to the left or right so that the user may load them. Any uneaten food items are placed in the side mounted retractable trash receptacle 60, while the dishes are placed into the dish trays 42 and 44 for washing. Once loaded with dishes and detergent, the user presses a control button 24 causing the trays 42 and 44 to realign themselves and retract into the dish washing assembly 40. The sliding doors 22 then close over the central opening 26. Next, the user selects a wash setting, then starts the wash cycle. When the cycle is complete, the user presses a control button 24 to open the covered doors 22, raise the trays 42 and 44, and unload them. Use of the table dishwasher 10 provides those in need of helpful household items to make their lives easier with a kitchen combination item which speeds up dish washing. The table dishwasher 10 also is very practical for those who have limited kitchen space without room for a conventional dishwasher, such as in small apartments or homes.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A table dishwasher, comprising:

a pedestal base including a central compartment;

a table top attached to the pedestal base, the table top including a central opening disposed over the central compartment and a table surface extending laterally out from the central opening;

a sliding door attached to the table top and disposed to move between a closed position covering the central opening and an open position spaced laterally out from the central opening; and a dishwasher disposed within the central compartment, the dishwasher including a dish receiving tray, the tray being movable between a lowered position within the central compartment and a raised position extending up from the central compartment above the table surface, the tray when in the raised position being pivotally movable laterally out from the central opening.

2. The table dishwasher of claim 1 further including a retractable trash receptacle attached to an underside of the table top, the receptacle being movable between an extended position spaced out from an edge of the table top and a retracted position spaced in from the edge of the table top.

3. The table dishwasher of claim 2 including a pair of sliding doors movable in cooperation between the closed position and the open position.

4. The table dishwasher of claim 3 wherein the table surface extends laterally out on opposite sides of the table pedestal and the pair of doors is slidably received under the opposite sides.

5. The table dishwasher of claim 2 including a pair of trays disposed in stacked relationship and being movable between the lowered position and the raised position.

6. The table dishwasher of claim 1 including a pair of sliding doors movable in cooperation between the closed position and the open position.

7. The table dishwasher of claim 6 wherein the table surface extends laterally out on opposite sides of the table pedestal and the pair of doors is slidable received under the opposite sides.

8. The table dishwasher of claim 1 including a pair of trays disposed in stacked relationship and being movable between the lowered position and the raised position.

* * * * *